US007004021B2

(12) United States Patent
Bilby et al.

(10) Patent No.: US 7,004,021 B2
(45) Date of Patent: Feb. 28, 2006

(54) METHOD AND SYSTEM FOR DETECTING CONDITIONS INSIDE A WELLBORE

(75) Inventors: Christopher M. Bilby, Houston, TX (US); Wilson Craig Barnett, Humble, TX (US); Jean Michel Beique, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 14 days.

(21) Appl. No.: 10/792,428

(22) Filed: Mar. 3, 2004

(65) Prior Publication Data

US 2005/0193811 A1 Sep. 8, 2005

(51) Int. Cl.
*E21B 47/00* (2006.01)
*E21B 44/00* (2006.01)

(52) U.S. Cl. ..... 73/152.43

(58) Field of Classification Search ..... 73/152.43, 73/152.01, 152.46
See application file for complete search history.

(56) References Cited

U.S. PATENT DOCUMENTS

| | | | | |
|---|---|---|---|---|
| 2,814,019 | A | 11/1957 | Bender | 324/34 |
| 2,817,808 | A | 12/1957 | Gieske | 324/34 |
| 3,762,218 | A | 10/1973 | Davis | 73/151 |
| 3,942,373 | A | 3/1976 | Rogers | 73/151 |
| 3,994,163 | A | 11/1976 | Rogers | 73/151 |
| 4,023,092 | A | 5/1977 | Rogers | 324/34 |
| 4,033,413 | A | 7/1977 | Rogers | 166/301 |
| 4,104,911 | A | 8/1978 | Lavigne et al. | 73/151 |
| 4,105,070 | A | 8/1978 | Lavigne et al. | 166/250 |
| 4,105,071 | A | 8/1978 | Nicolas et al. | 166/250 |
| 4,125,013 | A | 11/1978 | Nicolas et al. | 73/151 |
| 4,207,765 | A | 6/1980 | Kiff | 73/151 |
| 4,351,186 | A | 9/1982 | Moulin | 73/151 |
| 4,402,219 | A | 9/1983 | Hache | 73/151 |
| 4,444,050 | A | 4/1984 | Revett | 73/151 |
| 4,515,010 | A | 5/1985 | Weido et al. | 73/151 |
| 4,549,431 | A | 10/1985 | Soeiinah | 73/151 |
| 4,694,902 | A | 9/1987 | Hörmansdörfer | 166/250 |
| 4,708,204 | A | 11/1987 | Stroud | 166/255 |
| 4,715,451 | A | 12/1987 | Bseisu et al. | 175/40 |
| 4,802,143 | A | 1/1989 | Smith | 367/82 |
| 4,958,125 | A | 9/1990 | Jardine et al. | 324/162 |
| 4,966,234 | A | 10/1990 | Whitten | 166/250 |
| 5,138,875 | A | 8/1992 | Booer | 73/151 |
| 5,205,163 | A | 4/1993 | Sananikone | 73/151 |
| 5,235,259 | A | 8/1993 | Dhindsa et al. | 318/434 |

(Continued)

OTHER PUBLICATIONS

*SPE Paper* 14330, S.F. Wolf, et al., Field Measurements of Downhole Drillstring Vibrations.

*Primary Examiner*—Hezron Williams
*Assistant Examiner*—Rodney Frank
(74) *Attorney, Agent, or Firm*—Baker Botts L.L.P.

(57) ABSTRACT

Embodiments of methods and systems for detecting conditions inside a wellbore according to the invention are disclosed. One embodiment of the invention of the system includes a pipe (150) that is configured to rotate in a wellbore (140). A first detector (120) is located near the surface and is configured to measure a first parameter that correlates to rotation of the pipe (150). A second detector (160C) is located at a first depth away from the surface and is configured to measure a second parameter that correlates to rotation of the pipe (150). A circuit (130) is coupled to the first detector (120) and the second detector (160C) and is configured to compare the first and second parameters.

33 Claims, 5 Drawing Sheets

U.S. PATENT DOCUMENTS

| | | | | |
|---|---|---|---|---|
| 5,375,476 | A | 12/1994 | Gray | 73/862.331 |
| 5,431,046 | A | 7/1995 | Ho | 73/151 |
| 5,454,436 | A | 10/1995 | Jardine et al. | 175/40 |
| 5,520,245 | A | 5/1996 | Estes | 166/66 |
| 5,952,569 | A | 9/1999 | Jervis et al. | 73/152.01 |
| 6,401,838 | B1 | 6/2002 | Rezmer-Cooper | 175/38 |
| 6,564,883 | B1 * | 5/2003 | Fredericks et al. | 175/50 |
| 6,684,949 | B1 | 2/2004 | Gabler et al. | 166/250.01 |
| 2004/0007357 | A1 | 1/2004 | Gabler et al. | 166/250.01 |

* cited by examiner

METHOD AND SYSTEM FOR DETECTING CONDITIONS INSIDE A WELLBORE

BACKGROUND

The present invention relates to the field of energy services. In particular, the invention relates to a method and system for detecting conditions inside a wellbore.

Conditions inside a wellbore can include sticking between a rotating pipe and material downhole. For example, during drilling the drill pipe can become stuck. If a drill pipe that is stuck downhole continues to be rotated at the surface, excessive torque forces can result in the pipe twisting off. Conditions detected in a wellbore can be used to control operations at the surface in a manner that reduces the risk of damaging equipment.

DETAILED DESCRIPTION

Figure 1:
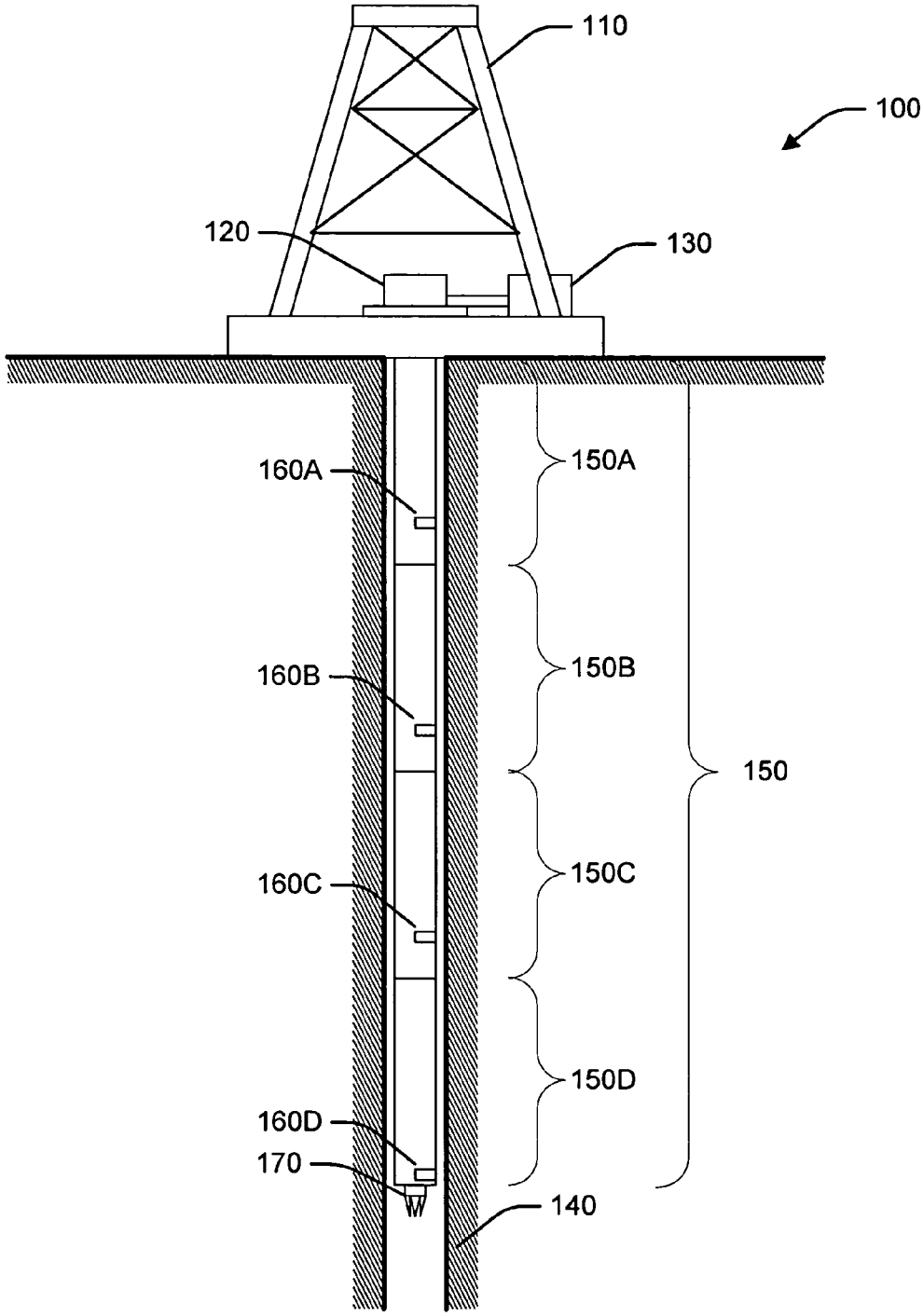
FIG. 1 is a block diagram of one embodiment of the invention of a system for detecting conditions inside a wellbore.

One embodiment of the invention of a system 100 for detecting conditions inside a wellbore is illustrated in FIG. 1. While the embodiment of the invention is shown for a vertical land well for petroleum products, the system for could also be used in other environments for monitoring conditions inside a wellbore. For example, the system can be used for a land well that deviates from vertical toward a horizontal orientation. As another example, the system can be used for a subsea well that is either vertical or deviates toward horizontal. A load bearing structure 110 is disposed above the wellbore 140. At the surface, a top drive or Kelley 120 is used to apply torque to the pipe 150, which responds to that torque by rotating in the wellbore 140. In one embodiment, a rotation detector is included with the top drive or Kelley 120 to measure the rotation of the pipe 150 at or proximate to the surface.

One example rotation detector is a light detector positioned to receive light from a light source at one point of each rotation. The light source can be placed on a structure that rotates at the same rate as the pipe proximate the surface. Another possibility is that the light detector itself rotates with the pipe while the light source is fixed. One potential light source would be a reflector. Another example rotation detector is a magnetic proximity switch that is positioned to encounter a target once per rotation of the pipe at the surface. Another example rotation detector is connected to the gearing of the top drive or Kelley and generates a signal corresponding to pipe rotation at the surface based on that gearing. Another example rotation detector is a magnetometer oriented in the X-Y plane with the pipe axis as the Z axis and rotationally fixed to the pipe or another structure that rotates at the same rate as the pipe. The magnetometer can detect rotation of the pipe by the corresponding changes in the strength of the earth's magnetic field as the magnetometer changes orientation as discussed in more detail with respect to FIG. 3. While the earth's field varies continuously, with a daily cycle due to the effects of the solar wind and sunspot activity superimposed over longer term changes from earth's core effects, those changes are very small compared to the changes that results from orientation of a magnetometer between a north-south orientation and either an east-west or up-down orientation. Another example detector is an inclinometer. If the pipe is oriented at an angle to the vertical, an inclinometer will detect the change in angle with respect to gravity as it rotates with the pipe. Another example detector is a vibratory gyroscope, which can be used as part of a microelectromechanical system or MEMS. A vibratory gyroscope contains a precision mechanically resonant structure containing two normal modes of vibration. It is excited to vibrate in one of its modes. Rotation of the gyroscope in combination with the vibration movement generates a normal Coriolis force that excites the second mode of vibration. The amplitude of the second mode of vibration is then detected. For example, the change in electrical resistance of a piezoresistor as a result of the second mode of vibration can be measured. These are just some examples of rotation detectors.

One embodiment of the system detects the rotation of the pipe at the surface. When the pipe gets stuck at a location below the surface, rotation at the surface can continue even though rotation below the surface has slowed or stopped. The pipe structure resists twisting of one portion of pipe relative to another, which is sometimes called "winding up." The torque applied to the pipe at the surface is increased to maintain the rotation speed at the surface. Detection of more rotation of the pipe at the surface relative to rotation at a depth below the surface provides an indication that torque build up is occurring as the pipe winds up. Detecting torque build up and reacting to it can decrease the risk of equipment damage.

Winding up can occur repetitively in the form of torsional vibration. For example, a pipe can become stuck at a particular depth and begin to wind up. The downhole torque resulting from the wind up can become great enough to overcome the frictional force at the point of sticking so that the pipe will then unwind with sticking occurring again once the torque has reduced. Detecting the variations between rotation speeds at two or more points on the pipe can diagnose that torsional vibration is occurring, where it is occurring, and its magnitude.

The pipe 150 can include a number of pipe segments 150A–150D. In one embodiment of the invention, several rotation detectors 160A–160D are mounted in the pipe segments 150A–150D at different depths. One of the rotation detectors 160D can be positioned with the drill bit 170. Each rotation detector can be, for example, a magnetometer oriented in the X-Y plane with the pipe axis as the Z axis. As discussed above with respect to the surface detector included with the top drive 120, in different embodiments alternative rotation detectors can be substituted for the magnetometers. Such a magnetometer could be coupled to the pipe so that it rotates with the pipe. Each rotation of the pipe sweeps the magnetometer through a 360 degree change in orientation that would include the magnetic north and magnetic south orientations. The magnetic field strength measured by the magnetometer would vary depending upon the angle of the detector relative to the magnetic poles. The variation in detected magnetic field strength would correlate to the rotation of the pipe. The wellbore 140 is shown in a vertical orientation. A wellbore can also deviate from vertical. A magnetometer being used as a rotation detector, e.g., 160A, will detect smaller magnetic field strength deviations resulting from the magnetic poles when the wellbore deviates from vertical. The variation in magnetic field strength can also be detected in circumstances where another magnetic component is present. For example, a background magnetic component contributed by magnetization of the pipe or other instruments present in the pipe can be subtracted from the magnetometer measurement to produce a signal that varies in accordance with pipe rotation. In one embodiment, magnetometers mounted in the pipe at different depths can be used without the use of a pipe rotation detector proximate to the surface.

A circuit 130, such as a programmed microprocessor or dedicated logic, can be used to receive the measurements made by the rotation detector proximate to the surface 120 and one or more rotation detectors 160A–160D placed at various depths in the wellbore 140. In one embodiment, the circuit 130 can compare the measurements themselves. For example, if magnetometers are used both proximate to the surface as well as at a depth in the borehole, the magnetic strength readings can be directly compared. If the pipe is rotating at the same rate at the detector locations (for example, at the surface and downhole)(as another example, at two different depths downhole) the measured magnetic strength readings will stay in phase. The circuit 130 may employ some processing to account for timing. For example, there may be a delay in receiving information from one of the detectors that can be accounted for by the circuit so that measurements made at the same time are compared. Circuit 130 can also compare the detector measurements by calculating the rotation speed of the pipe at the detector locations and comparing the calculated speeds. When the comparison indicates a difference in rotation and different points of the pipe, the circuit 130 can generate a signal if the comparison meets a particular condition. For example, if the rotation speed downhole lowers relative to the rotation speed at the surface, over time the pipe will wind up and the circuit 130 can send a signal to the top drive or a rotary table to stop applying torque. Such a signal could prevent equipment damage, including damage to the pipe 150.

The circuit 130 can also compare measurements from several detectors 160A–160D positioned at different depths to estimate the depth at which the pipe 150 is stuck. For example, the circuit 130 can receive measurements from detector 120 proximate to the surface and two detectors 160A, 160C at different depths in the wellbore 140. If the difference in rotation speed is between the surface and both downhole depths, the circuit can estimate that the pipe 150 is stuck somewhere above the first detector 160A. If, however, there is a significant difference in rotation speed between the two downhole detectors 160A, 160C, the circuit 130 can estimate that the pipe 150 is stuck between the two detectors.

Figure 2:
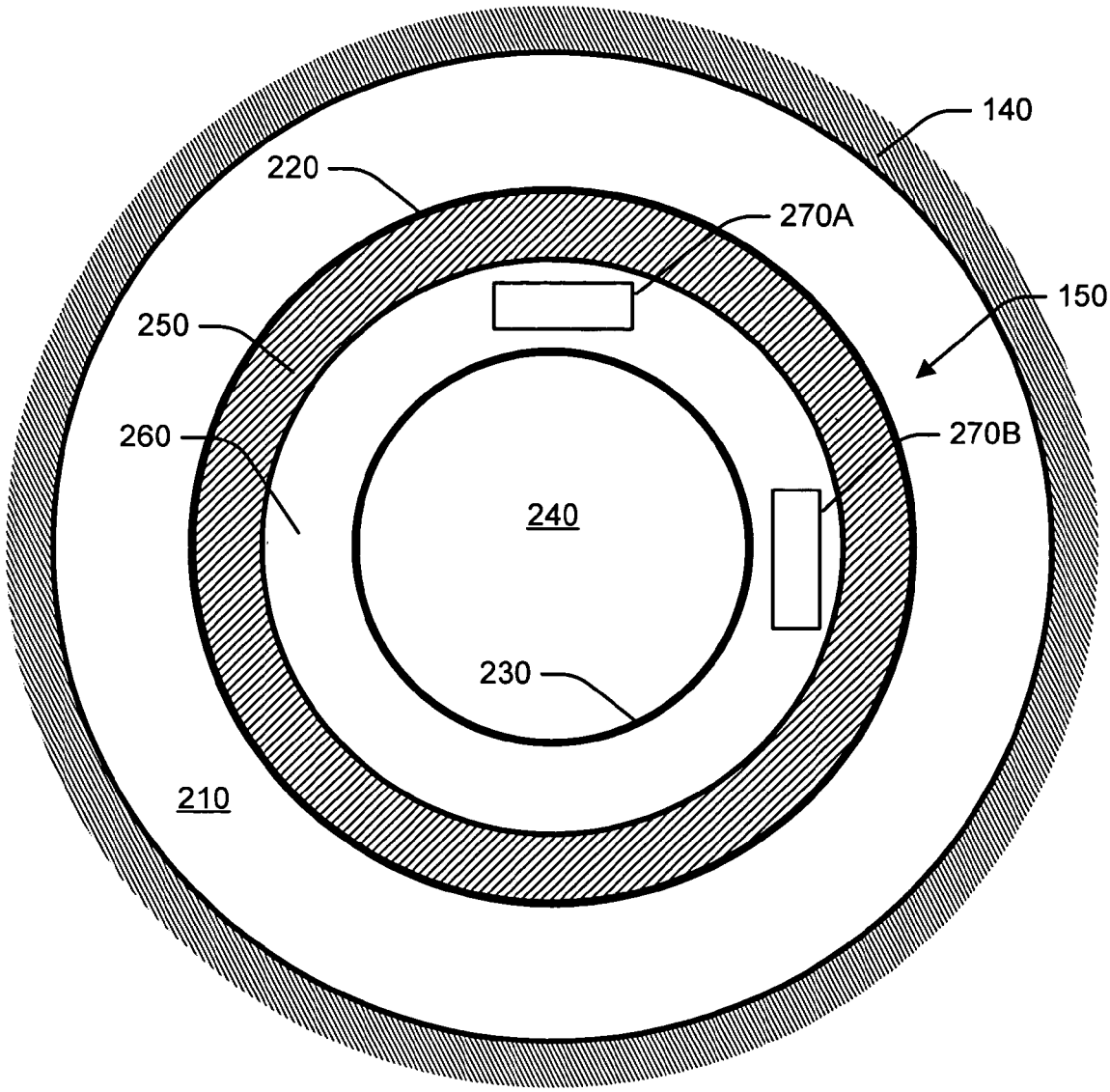
FIG. 2 is a cross section of the pipe shown in FIG. 1 at a detector depth.

FIG. 2 is a cross section of the pipe 150 shown in FIG. 1 at a detector depth. Inside the wellbore 140, the pipe 150 has an exterior wall 220 and an interior wall 230. An annular space 210 is defined between the wellbore 140 and the exterior wall 220. In one example application, the annular space allows fluid to flow toward the surface from downhole. In one embodiment, the pipe 150 includes a solid steel layer 250 that provides structural strength. Another layer 260 of the pipe is not solid and provides a location for placing tools and detectors. For example, layer 260 can include magnetometers or cable for relaying signals from tools mounted on or in the pipe 150. The interior wall 230 can protect the tools, instruments, and cables in layer 260 by providing a seal from fluids in the center 240 of the pipe 150. For example, fluid can be pumped down the center 240 of the pipe 150 during drilling. In that example application, the same fluid can return to the surface though the annular space 210 with debris resulting from the drilling. Two separate detectors 270A and 270B are shown oriented perpendicularly to each other and both in the X-Y plane. While one detector can be used by itself, in another embodiment a second detector 270B can also be employed at a particular depth to confirm or calibrate the parameter measured by the first detector 270A. For example, if the detectors 270A, 270B are magnetometers, the second magnetometer 270B can be used to confirm or calibrate the magnetic field strength measured by the first magnetometer 270A after a quarter revolution.

Figure 3:
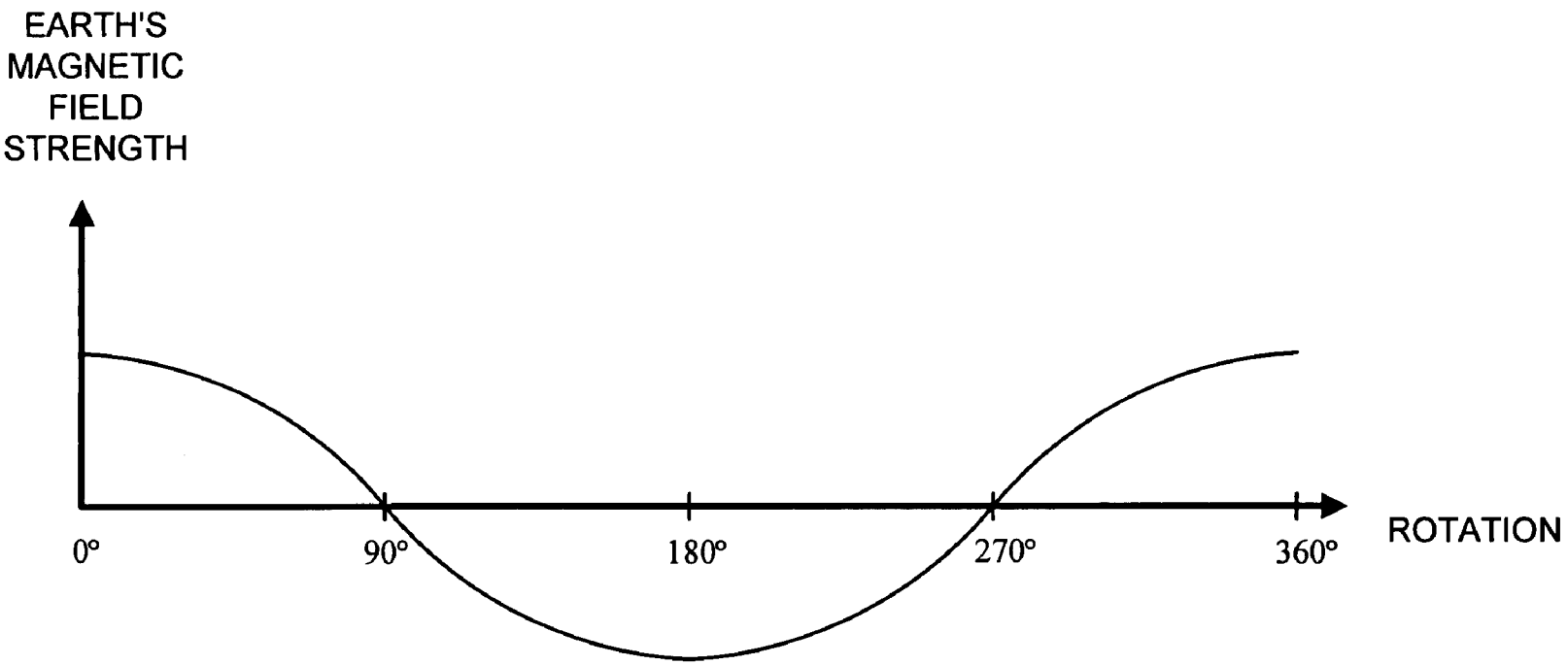
FIG. 3 is a graph indicating the change in measurement of the earth's magnetic field strength as a function of the rotational position of the pipe.

If the pipe is oriented vertically, its rotation will change the orientation of detectors in the X-Y plane, with the Z-axis being the pipe axis, to point at each of the cardinal directions in sequence. In the detectors are magnetometers, the change in cardinal orientation will vary the detection of the earth's magnetic field. The detected field will be an absolute maximum when the detector is oriented north or south and zero when the detector is oriented east or west. FIG. 3 is a graph indicating the change in measurement of the earth's magnetic field strength as a function of the rotational position of the pipe. A horizontal deviation of the pipe to the east and west will not change the variation in measurement of the earth's magnetic field because the detector will still be oriented north at one point of the rotation, south at another point, and normal to both north and south at two other points of the rotation. For this reason an output similar to that shown in FIG. 3 would still be expected. To the extent the pipe deviates from vertical relative to the north and south, the variation in the earth's magnetic field strength measured by X-Y plane oriented detectors would lessen. Such detectors in a pipe horizontally positioned along the north-south axis would show no variation because every orientation along the rotation would be normal to the north-south axis. In such a situation, a different detector such as a magnetic proximity detector or vibratory gyroscope could be used.

Figure 4:
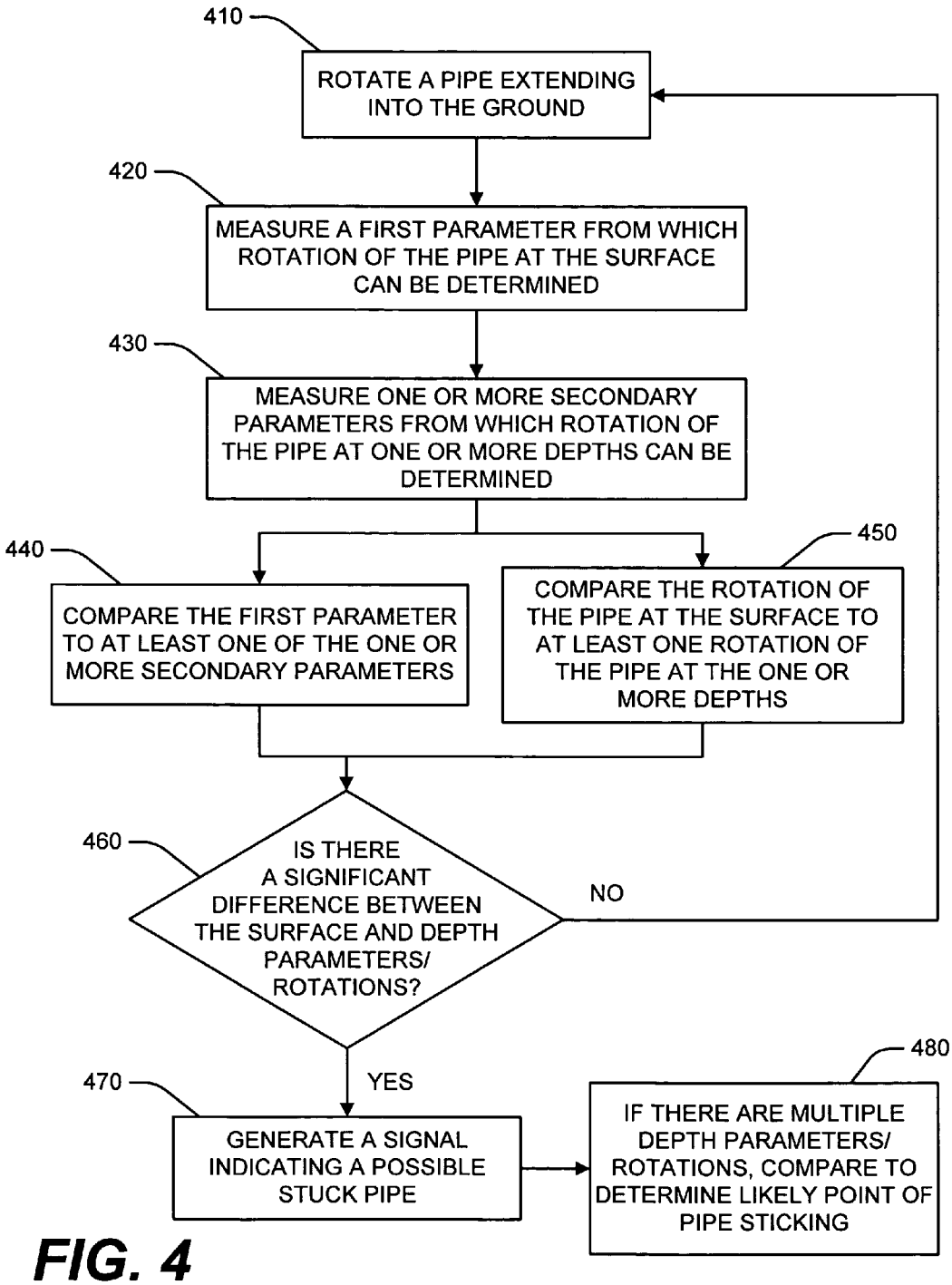
FIG. 4 is a flowchart to implement a method for detecting conditions inside a wellbore according to one embodiment of the invention.

FIG. 4 is a flowchart to implement a method to detect conditions inside a wellbore according to one embodiment of the invention. At 410, a pipe that extends into the ground is rotated. In one embodiment, the pipe is a drill pipe. A first parameter is measured at 420 from which rotation of the pipe at the surface can be determined. One or more secondary parameters are measured at 430 from which rotation of the pipe at one or more depths can be determined. In one embodiment at 440, the first parameter is directly compared to at least one of the one or more secondary parameters. In another embodiment at 450, the parameters are compared by calculating the rotation of the pipe at the surface based at least in part on the first parameter and comparing the surface rotation to the rotation of the pipe at one or more depths calculated based at least in part on the one or more secondary parameters. In another embodiment, magnetic field strengths measured at two different depths are compared. At 460, if the comparison does not identify a significant difference, wellbore conditions during pipe rotation continue to be monitored starting at 410. If the comparison does identify a significant difference at 460, then a signal is generated at 470 indicating the possibility of a stuck pipe. The difference can also be used to automatically adjust the operation of equipment that is applying torque to the pipe. A closed-loop system that responds to differences in rotation at different depths can reduce the wear on equipment by reducing torsional vibration.

In one embodiment, a difference is significant if it exceeds a predetermined threshold. As one example, the threshold may be a certain number of rotations difference per depth. Thus, if the threshold is one rotation for a measurement at a particular depth, in one embodiment, the threshold is two rotations at twice the depth, where the difference is in comparison to the surface. After a signal is generated at step 470, the likely sticking point is determined at 480 if there are multiple secondary parameters. For example, if a first parameter is measured proximate to the surface and two parameters are measured at different depths, the difference in parameters between the three measurements can determine a likely sticking point between the measurements with the greatest difference. The sticking point may also be identified by a nonlinear parameter value. For example, rotation speed may decrease linearly as a function of distance toward the surface from the stuck point, but the change of rotation between the sensors above and below the stuck point may not that follow that linear relationship.

Multiple measurements of rotation-correlated parameters also can be useful in downhole operations such as sliding. A sliding operation involves rotating a drill bit with a mud motor rather than by rotation of the drill string. The drill string may rotate at a different rate than the drill bit. One embodiment of the invention can monitor the rotation of the drill string at the surface and/or one or more depths and the rotation of the drill bit. In one embodiment, the rotation of the drill bit is monitored by detecting the rotation of the mud motor.

Figure 5:
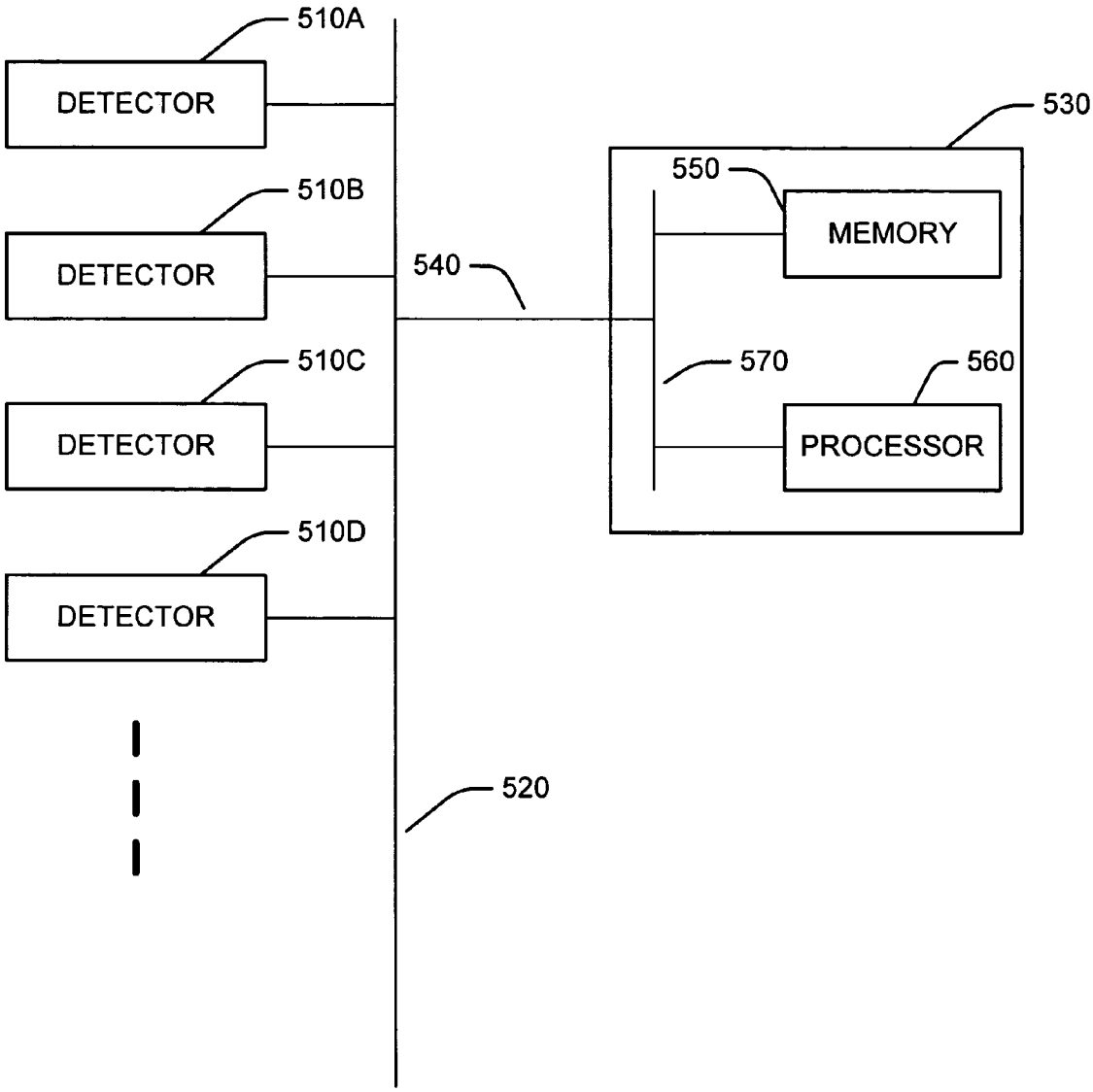
FIG. 5 is a block diagram of one embodiment of a system for detecting conditions inside a wellbore.

FIG. 5 is a block diagram of a system by which measurements made at detectors are communicated to a circuit. The detectors 510A–510D can be located at different positions in a wellbore a previously discussed. Each of the detectors 510A–510D is coupled to a communications medium 520. For example, the communications medium 520 could be an ADSL link between downhole detectors and the surface. As another example, the communications medium 520 could be a wireless communications link. In one embodiment, the communications medium 520 includes multiple communications links such as an ADSL link in the wellbore and a satellite link from the surface to a processing location. While the depicted embodiment shows the detectors 510A–510D coupled to a common medium 520, the detectors 510A–510D could also be coupled by individual links. The detectors 510A–510D use the communications medium 520 to send parameter measurements to a circuit. In one embodiment, the circuit is a programmed processor 560. For example, a computer 530 can include a processor 560 and memory 550 that contains the programming for the processor 560 and can be used by the processor 560 to store data including parameter measurements received from the detectors 510A–510D. In one embodiment, the computer 530 sends and receives data via a port 540, for example a USB or serial port, coupled to the communications medium 520. Modems may also be used to process signals sent or received between the detectors 510A–510D and the computer 530. In one embodiment, the computer 530 sends messages to the detectors 510A–510D in addition to receiving parameter measurements. For example, the messages can include calibration instructions and instructions to begin measuring and sending measurements. The parameter measurement data may also include data indicating the time at which the parameters were measured. Additional messages can be sent between the computer 530 and the detectors 510A–510D to maintain a synchronized time reference.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A method of detecting pipe movement in a wellbore, comprising:

rotating a pipe extending into the wellbore from a surface;

measuring a first parameter that correlates to rotation of the pipe proximate the surface;

measuring a second parameter that correlates to rotation of the pipe in the wellbore at a first depth away from the surface; and comparing the first and second parameters.

2. The method of claim 1 where the pipe is a drill pipe.

3. The method of claim 1 where the step of comparing the first and second parameters includes determining whether the difference between the parameters exceeds a predetermined value.

4. The method of claim 1 where the step of comparing the first and second parameters includes:

calculating a surface rotation of the pipe based at least in part on the first parameter;

calculating a rotation of the pipe at the first depth based at least in part on the second parameter; and comparing the surface rotation to the rotation of the pipe at the first depth.

5. The method of claim 1 further comprising:

generating a signal when the comparison of the first and second parameters satisfies a predetermined condition.

6. The method of claim 1, further comprising:

measuring a third parameter that correlates to rotation of the pipe in the wellbore at a second depth further away from the surface than the first depth; and comparing the first, second, and third parameters to locate a stuck point relative to the surface, the first depth, and the second depth.

7. The method of claim 1, further comprising:

performing the steps of measuring the first and second parameters and comparing the measured parameters periodically.

8. The method of claim 1 where the second parameter is the output of a magnetometer oriented in the X-Y plane and rotationally fixed to the pipe at the first depth.

9. The method of claim 1 where the first parameter is the output of a magnetic proximity switch positioned to detect an object rotating at the same rate as the pipe proximate the surface at one point on its rotation.

10. The method of claim 1 where the first parameter is the output of a magnetometer oriented in the X-Y plane and rotationally fixed to the pipe proximate the surface.

11. The method of claim 1 where the second parameter is the output of a vibratory gyroscope positioned to measure rotation and rotationally fixed to the pipe at the first depth.

12. A system, comprising:

a pipe configured to rotate in a wellbore;

a first detector located proximate to the surface configured to measure a first parameter that correlates to rotation of the pipe;

a second detector located at a first depth away from the surface configured to measure a second parameter that correlates to rotation of the pipe; and a circuit coupled to the first and second detectors configured to compare the first and second parameters.

13. The system of claim 12 where the pipe is a drill pipe.

14. The system of claim 12 where the circuit is configured to compare the first and second parameters by determining whether the difference between the parameters exceeds a predetermined value.

15. The system of claim 12 where the circuit is configured to compare the first and second parameters by:

calculating a surface rotation of the pipe based at least in part on the first parameter;

calculating a rotation of the pipe at the first depth based at least in part on the second parameter; and comparing the surface rotation to the rotation of the pipe at the first depth.

16. The system of claim 12 where the circuit is further configured to:

generate a signal when the comparison of the first and second parameters satisfies a predetermined condition.

17. The system of claim 12, further comprising:

a third detector located at a second depth further away from the surface than the first depth configured to measure a third parameter that correlates to rotation of the pipe; and where the circuit is further configured to compare the first, second, and third parameters to locate a stuck point relative to the surface, the first depth, and the second depth.

18. The system of claim 12, where the first and second detectors measure the first and second parameters periodically and the circuit compares the parameters periodically.

19. The system of claim 12 where the second detector is a magnetometer oriented in the X-Y plane and rotationally fixed to the pipe at the first depth.

20. The system of claim 12 where the first detector is a magnetic proximity switch positioned to detect an object rotating at the same rate as the pipe proximate the surface at one point on its rotation.

21. The system of claim 12 where the first detector is a magnetometer oriented in the X-Y plane and rotationally fixed to the pipe proximate to the surface.

22. The system of claim 12 where the circuit is a processor configured to process information in accordance with a program.

23. The system of claim 12 where the second detector is a vibratory gyroscope positioned to measure rotation and rotationally fixed to the pipe at the first depth.

24. A method of detecting pipe movement in a wellbore, comprising:

rotating a pipe extending into the wellbore from a surface;

measuring a first magnetic field strength at a first detector coupled to rotate with the pipe at a first depth;

measuring a second magnetic field strength at a second detector coupled to rotate with the pipe at a second depth; and comparing the first and second magnetic field strengths.

25. The method of claim 24 where the first magnetic field strength is measured using a magnetometer oriented in the X-Y plane and rotationally fixed to the pipe at the first depth.

26. The method of claim 24 further comprising:

generating a signal when the comparison of the first and second magnetic field strengths satisfies a predetermined condition.

27. The method of claim 24, further comprising:

performing the steps of measuring the first and second magnetic field strengths and comparing the measured magnetic field strengths periodically.

28. A system, comprising:

a pipe configured to rotate in a wellbore;

a first detector coupled to rotate with the pipe at a first depth and configured to measure a first magnetic field strength;

a second detector coupled to rotate with the pipe at a second depth and configured to measure a second magnetic field strength; and a circuit coupled to the first and second detectors configured to compare the first and second magnetic field strengths.

29. The system of claim 28 where the first detector is a magnetometer oriented in the X-Y plane.

30. The system of claim 28 where the circuit is further configured to:

generate a signal when the comparison of the first and second magnetic field strengths satisfies a predetermined condition.

31. The system of claim 28, where the first and second detectors measure the first and second magnetic field strengths periodically and the circuit compares the magnetic field strengths periodically.

32. A method of detecting pipe movement in a wellbore, comprising:

rotating a pipe extending into the wellbore from a surface and including a drill bit;

measuring a first parameter that correlates to rotation of the pipe proximate the drill bit;

measuring a second parameter that correlates to rotation of the pipe in the wellbore at a first depth away from the drill bit; and comparing the first and second parameters.

33. A system, comprising:

a pipe configured to rotate in a wellbore and including a drill bit;

a first detector located proximate to the drill bit configured to measure a first parameter that correlates to rotation of the pipe;

a second detector located at a first depth away from the drill bit configured to measure a second parameter that correlates to rotation of the pipe; and a circuit coupled to the first and second detectors configured to compare the first and second parameters.

* * * * *